US007842150B2

(12) United States Patent
Schmidkonz

(10) Patent No.: US 7,842,150 B2
(45) Date of Patent: Nov. 30, 2010

(54) ADHESIVE BINDING METHOD AND DEVICE FOR CARRYING OUT THIS METHOD

(76) Inventor: Peter Schmidkonz, Taubenweg 3-7, Nittenau (DE)

( * ) Notice: Subject to any disclaimer, the term of this patent is extended or adjusted under 35 U.S.C. 154(b) by 999 days.

(21) Appl. No.: 10/570,823

(22) PCT Filed: Sep. 9, 2004

(86) PCT No.: PCT/DE2004/002020

§ 371 (c)(1),
(2), (4) Date: Mar. 6, 2006

(87) PCT Pub. No.: WO2005/023555

PCT Pub. Date: Mar. 17, 2005

(65) Prior Publication Data

US 2007/0031211 A1 Feb. 8, 2007

(30) Foreign Application Priority Data

Sep. 9, 2003 (DE) ..... 103 41 493

(51) Int. Cl.
*B42B 5/00* (2006.01)
*B42C 9/00* (2006.01)
*B31F 5/04* (2006.01)

(52) U.S. Cl. ..... 156/211; 156/227; 156/252; 156/443; 156/513; 412/7

(58) Field of Classification Search ..... None
See application file for complete search history.

(56) References Cited

U.S. PATENT DOCUMENTS

| | | | | |
|---|---|---|---|---|
| 3,588,085 | A | 6/1971 | Bailey et al. | |
| 4,951,867 | A | 8/1990 | Michalik et al. | |
| 5,634,758 | A | 6/1997 | Leu et al. | |
| 5,768,969 | A * | 6/1998 | Dalfiume | 83/660 |
| 2003/0170094 | A1 * | 9/2003 | Yew | 412/7 |

FOREIGN PATENT DOCUMENTS

| | | |
|---|---|---|
| EP | 0 841 649 | 5/1998 |

* cited by examiner

*Primary Examiner*—Richard Crispino
*Assistant Examiner*—Barbara J. Musser
(74) *Attorney, Agent, or Firm*—Welsh Flaxman & Gitler LLC

(57) ABSTRACT

In order to produce an adhesive binding for bookbinding, in which the sheets, in letter paper format, are perforated on the folding edge, folded, provided with adhesive on the folding edge and assembled to form a book block, the perforating process is carried out on the folding edge in such a manner that two interrupted perforation lines are punched, these perforation lines being parallel at a short distance from one another, offset in a longitudinal direction and forming a widened folding edge. The punch locations of both perforation lines are, along the folding edge, offset by the length of one perforating tooth. The sheets, which are folded on the folding edge and which are assembled and squeezed to form a book block, are provided with the application of adhesive on surfaces, which are formed by the double perforating and which are assigned to one another, between full locations of one perforation line and full locations of the other perforation line.

18 Claims, 5 Drawing Sheets

ADHESIVE BINDING METHOD AND DEVICE FOR CARRYING OUT THIS METHOD

BACKGROUND OF THE INVENTION

This invention refers to a process and a device for performing an adhesive binding.

The process of adhesive binding of sheets to be combined into a book block is carried out in such a manner that the back of the block of sheets, which in their entirety form the book block, is provided with adhesive material and is pressed together. According to this process the adhesive material can flow only in a direction across the back into the edge areas of the sheets at the joint to a minimum extent so that the bonding area is very small and so that only a very limited degree of strength of the bonding area is obtained.

A higher degree of strength is obtained by using the so-called fanning technique according to DE 103 41 493.2 with which the sheets forming the book block are fanned while the back of the not yet completed book block (in the form of the clamped sheets) is provided with adhesive material. By fanning the sheets the adhesive material is able to penetrate into the back of the sheets so that a larger bonding area is obtained.

On the one hand the fanning technique requires a special device, on the other hand, fanning the sheets of the block and applying the adhesive material is not as exact as required so that also this solution especially for small-scale series production is not satisfactory. Because the fanning and bonding process with sheets of thicker paper causes problems on account of the material, there is still no satisfactory solution available for binding book blocks from unusual, for example thicker paper, especially when making books in small-scale series.

It is an object of this invention to propose a process and a device for adhesive binding, by means of which book blocks can be made of sheets of high quality, stiff paper, which are difficult to bond, which are made ready for adhesive bonding to obtain a substantially higher binding strength by a simple adhesive-applying technique, the opening characteristic of books is substantially improved, and especially an adhesive bonding of materials is possible, which materials up to now have been known as not being bondable by adhesive material.

SUMMARY OF THE INVENTION

This invention makes it possible to manufacture and process the folding edge of sheets combined into a book block at the predetermined position, namely the binding edge in such a manner that the front sided and the rear sided or alternatively the first and the next following sheet have alternating recesses, which concerning their width and their length are used as adhesive receiving areas. In view of their identical pitch the adjacent sheets have equal alternating recesses so that with the compressed stack of sheets laterally shifted, longitudinally continuous free spaces with the thickness of the sheet are obtained for receiving adhesive material. In this manner an extremely firm adhesive binding is obtained at both sides. When turning over the sheets in their bound condition the sheets bend at the line which is determined by the transient of the throughgoing paper to the overhanging remaining part of 50%. The overhanging sheet parts are stuck so that they practically cannot move within an adhesive film so that such book blocks can be opened into a substantially flat position. This has the advantage that the individual pages can be copied free of distortions.

Processing the folding or sheet edges can be reached according to the invention by designing the cutting geometry of linear or alternatively circular cutting tools, especially knives. Preferably, double slot perforating knives or wheels can be used for sheet-wise processing double sheets (with four pages), whereby the halves of the sheets are connected with each other by small transversal webs. Providing circular or alternatively wheel-type knives is useful preferably with roller printers and folding machines. The tool is insertable into crucible/cylinder printing machines.

A different cutting geometry according to the invention is the meander type knives or wheels, which preferably can be used for multiple cuts, whereby the adjacent sheets are staggered by half a pitch. This meander-type design of cutting edges covers as well a rectangular meander shape as also a wave-like meander shape, a dovetail shape or the like.

With a double slit perforation the web between each of two adjacent recesses can be maintained. Subsequent to the slit perforating step the sheet is folded. According to an alternative method a sheet with full meander shape is cut or perforated and folded together, or alternatively an interrupted transversal cutting line is provided with an interrupted meander-type shape.

Alternatively, it is also possible to cut individual sheets separately and put them together, whereby the individual sheets are cut in the stack and shifted in view of each other. On the other hand the entire stack can be cut equally and subsequent thereto can be put together so that subsequent sheets are staggered by one tooth pitch of the perforation. Basically, individual pockets or recesses can be punched or cut and combined in a staggered manner relative to each other. This can be done by punching notches or milling channels, whereby the stack of sheets is processed in such a manner that the sheets alternatively have a length changing by half a pitch and before punching/milling are pushed up, for example at the head cut and subsequent to punching/milling at the foot cut (or vice versa).

BRIEF DESCRIPTION OF THE DRAWINGS

In the following the invention is described with reference to the drawings by embodiments represented in the drawings in purely schematic form.

DETAILED DESCRIPTION OF THE INVENTION

Figure 1:
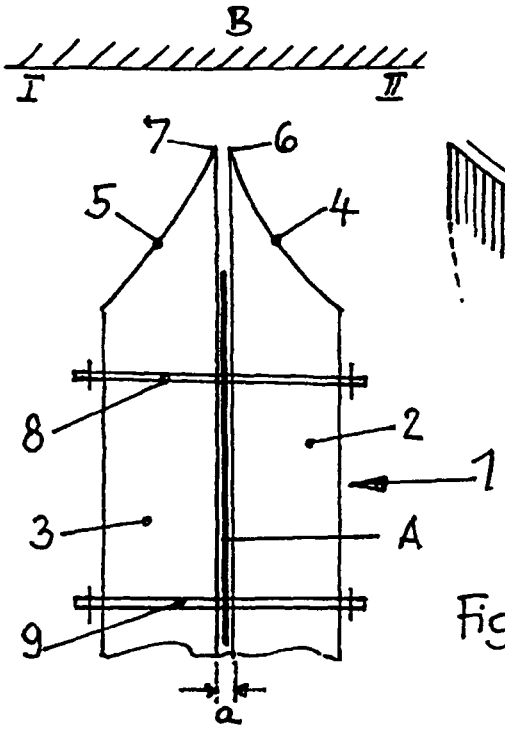
FIG. 1 shows a schematic representation of the perforating knife system in front view.

In FIG. 1 a double perforating knife 1 is shown, which consists of two individual perforating knives 2, 3. The knife teeth 4, 5 and the cutting edges 6, 7 are schematically shown. The two individual perforating knives 2, 3 have a distance a from each other at least at the cutting edges, this distance a can be adjusted according to the thickness of the material of the sheet B to be perforated, and can be varied by additional spacers A. The perforation knives are releasably fastened by screws 8, 9.

Figure 3:
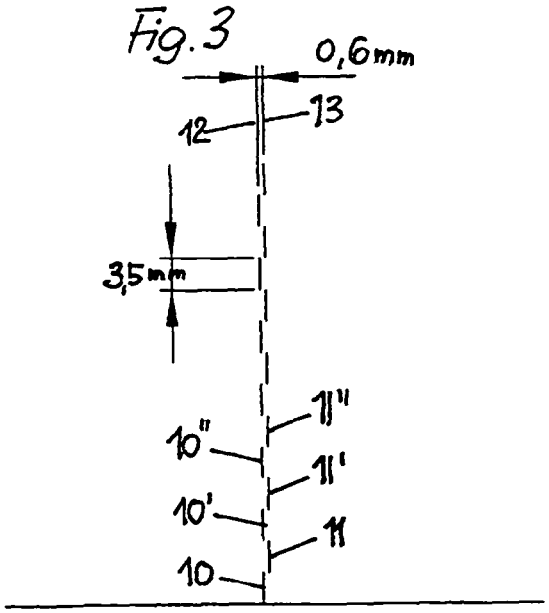
FIG. 3, shows a basic representation of a double folding line produced by the punching tool according to FIG. 2.
Figure 4:
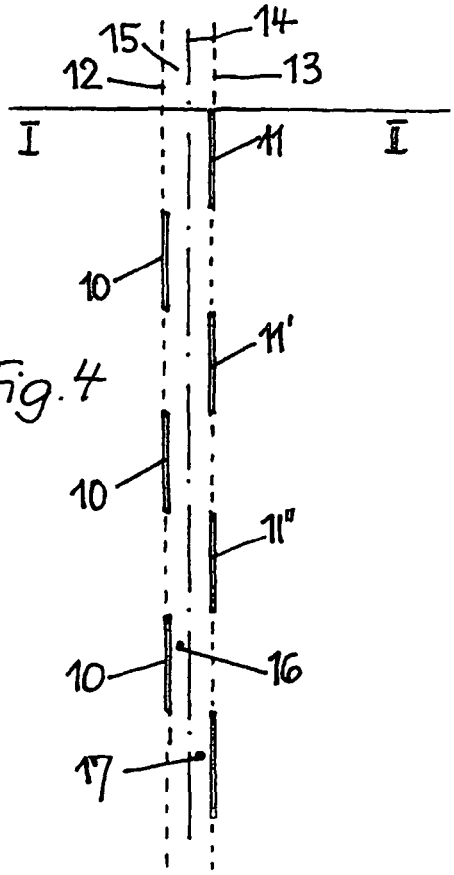
FIG. 4 is a schematic view of two perforated sheets in the folded-up condition.
Figure 2:
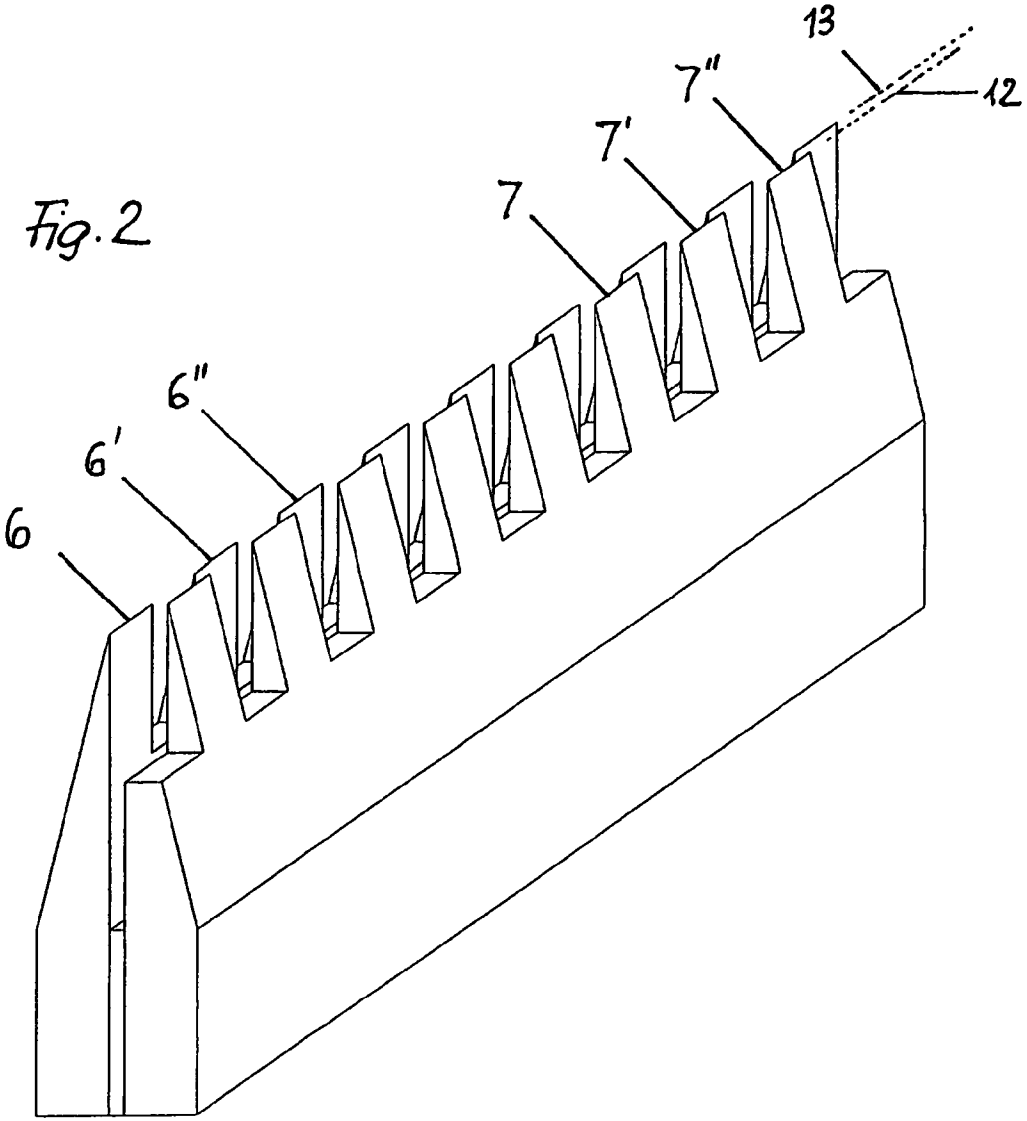
FIG. 2 is a perspective view of a punching tool combined from two symmetrical punching elements according to FIG. 1.

The double perforation tool 1 is shown in a perspective view in FIG. 2 showing its structure and its operation mode. The cutting edges or teeth 6, 6', 6", . . . are for punching the slots 10, 10', 10", . . . , the cutting edges or teeth 7, 7', 7" . . . are for punching the slots 11, 11', 11", . . . according to FIG. 3. With a special embodiment of the invention the distance of the two perforation lines 12 and 13 is for example 0.6 mm, the length of a tooth 6 or 7 is for example 3.5 mm. FIG. 4 shows a virtual folding line or hinge line 14 around which the two halves of a punched sheet are folded when making a book block, and based on the punched slots a fold strip 15 is formed the width of which is determined by the distance of the slots 10 and 11. The slots 10 and 11 each have a distance of a tooth width in the direction of the fold line, and are arranged leaving a gap, which means they are staggered by one tooth width. The perforation slots 10, 11 with this embodiment are not connected with each other by transversal webs so that when folding one sheet punched by a double perforating knife around the central folding line or hinge line 15, the resulting recesses 16, 17 are arranged leaving a gap in the longitudinal direction (along the folding line), and in their folded condition are bent around and are arranged joining each other so that the edge lines in total have a meander-like path. The surfaces of the recesses 16, 17 form the areas onto which adhesive material is applied so that when putting together and compressing the sheets into a book block alternating pairs of recesses of adjacent sheet halves lying one above the other are bonded together, which results in a high quality, long term bonding.

Figure 5:
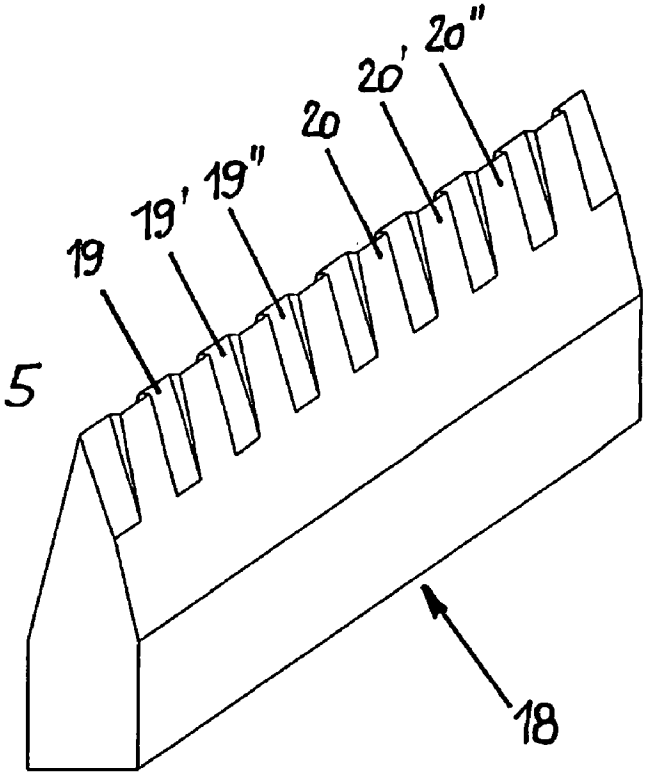
FIG. 5 shows a one-part punching tool.
Figure 6:
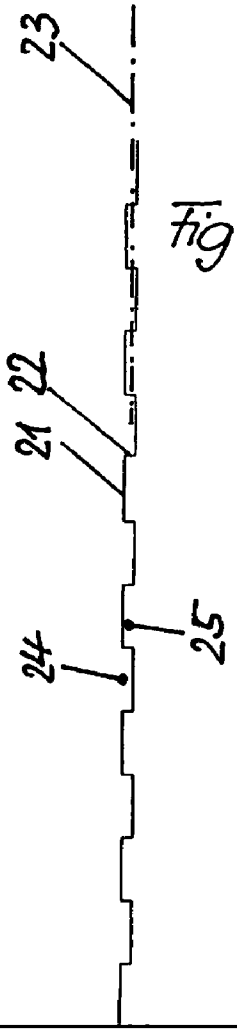
FIG. 6 shows the cutting edge of the tool according to FIG. 5.

With another embodiment of the invention according to FIG. 5 the double perforation tool 18 is a one-piece tool with which the cutting teeth 19, 19', 19", . . . and 20, 20', 20", . . . have a continuous meander-type path and punch as well longitudinal slots 21, 21', 21", . . . as also transversal slots 22, 22', 22", . . . connecting two adjacent opposite longitudinal slots with each other. The folding line or hinge line is marked with 23, and the recesses 24, 25 are folded alternatively in opposite direction around the hinge line so that when folding the sheets around the central line of the meander path, the recess areas are available for bonding with their full surface, whereas the transversal lines of the meander path form the hinge points.

Figure 7:
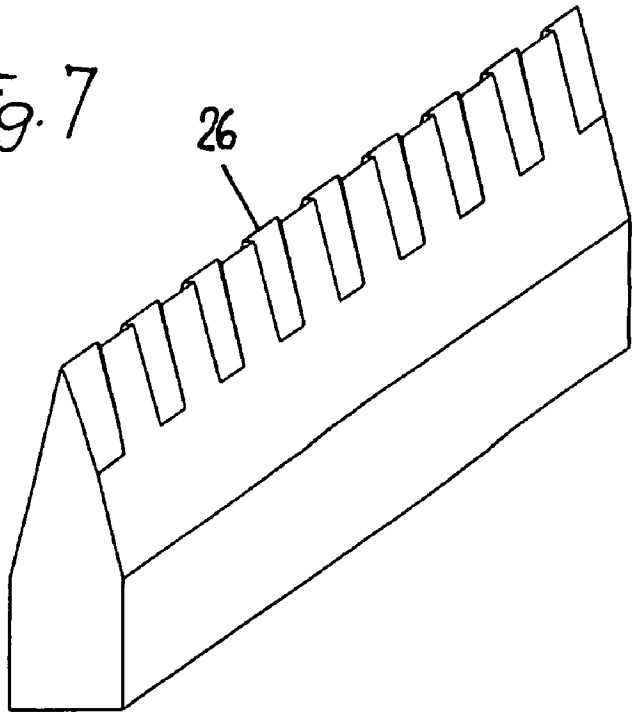
FIG. 7 is another different embodiment of a one-part cutting tool.
Figure 8:
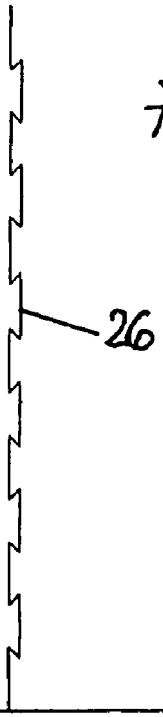
FIG. 8 shows the cutting edge of the tool according to FIG. 7.

A variation of FIG. 5 is shown in FIG. 7. The cutting edge 26 of the perforation line has the shape of a dove tail similar thereto the perforation line also can be formed as a wave-type line.

Figure 9:
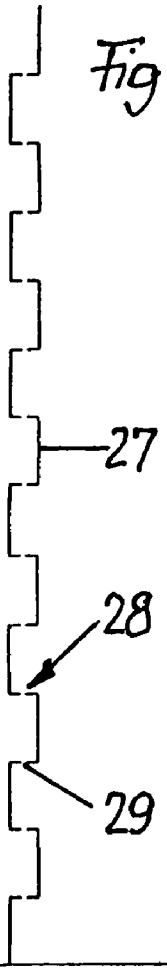
FIG. 9 is a further embodiment of a cutting edge of a cutting tool.

With a further embodiment the cutting edge of a cutting tool the continuous cutting edge 27 in the transverse web 28 is discontinuous, for example with interruptions or perforations 29, as shown in FIG. 9. In this embodiment a hinge connection each is left at the punching line of the transversal web, and two adjacent recesses of the sheet halves are connected each other by said hinge connection so that a defined hinge axis is produced around which the sheet halves will be folded.

Figure 10:
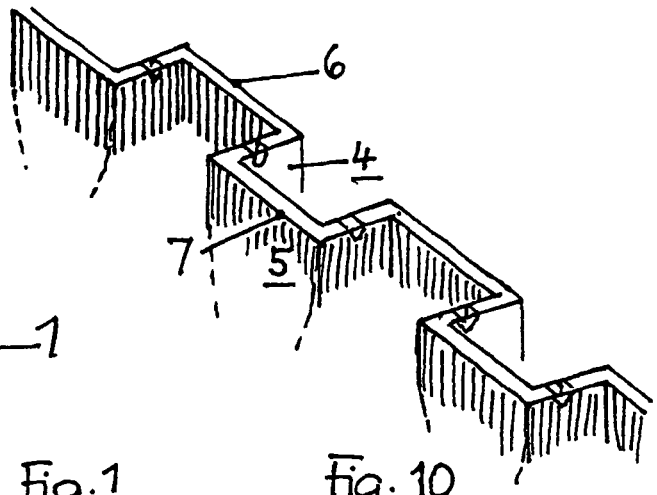
FIG. 10 is a schematic, perspective picture of a number of adjacent perforation teeth in meander-type form with interruptions within the transversal webs.

Instead of a linear cutting tool according to the preceding figures, FIG. 10 shows a rotating cutting or punching tool which functionally corresponds the punching knife shown in FIG. 2, and is made-up of two symmetrical halves. With this type of punching knife perforation lines according to the tool shown in FIG. 5 can be made.

Figure 11:
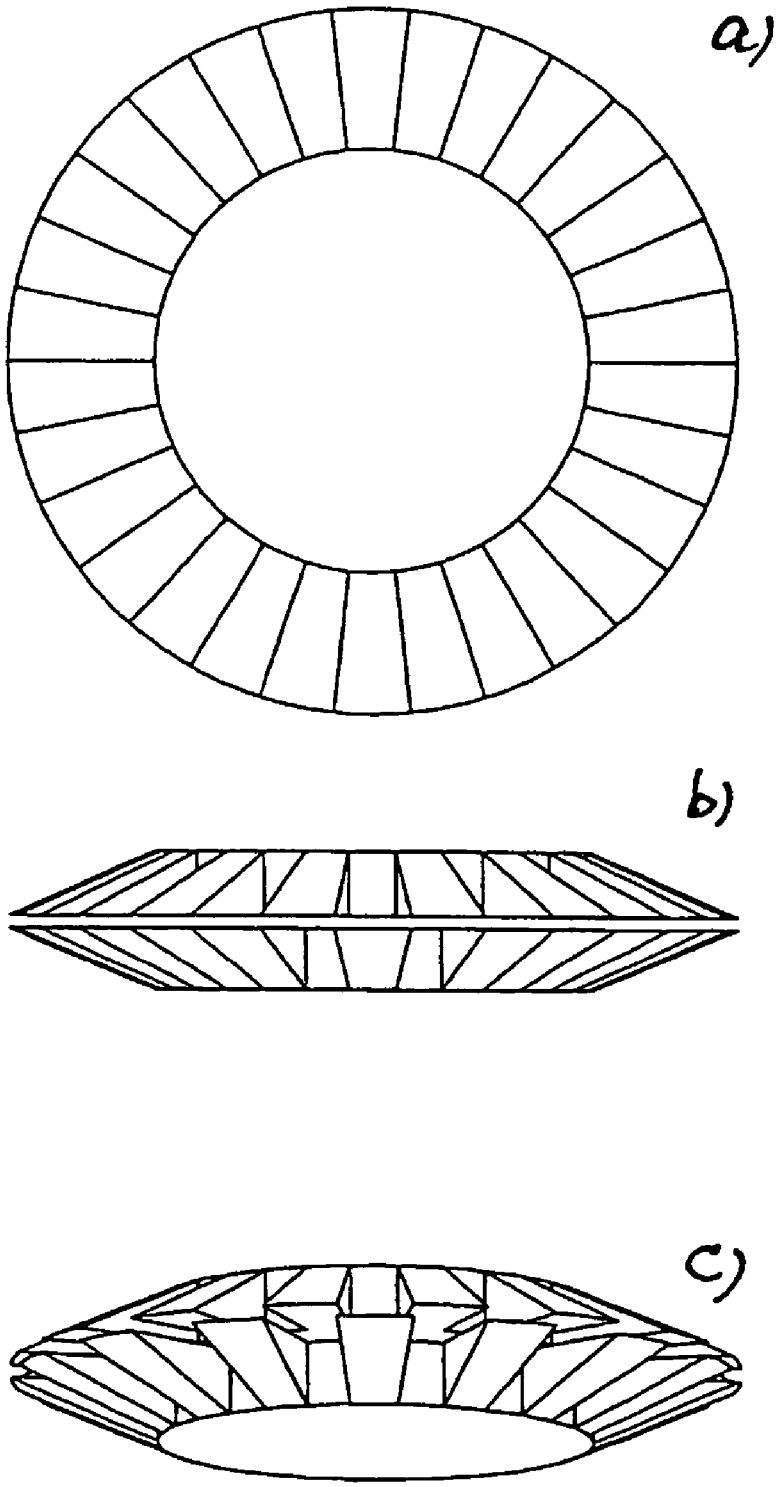
FIG. 11 shows a rotational punching tool a) in plan view, b) in front view and c) in perspective view.

FIG. 11 shows a rotating tool which similar to the linear tool of FIG. 5 is made-up of two symmetrical halves, and results in perforation lines equivalent hose of the tool of FIG. 5.

What is claimed is:

1. A process for the adhesive connection of sheets in the book-binding field by perforating the sheets along a folding edge, folding the perforated sheets, applying adhesive onto the folding edge, and assembling the sheets into a book block, wherein the perforating process is performed along the folding edge so that two interrupted perforation lines extending a small distance from each other and staggered longitudinally from each other are punched in the shape of a double slit line forming a widened folding edge, the punched spots of the two perforation lines are staggered in view of each other by the length of one perforating tooth in the longitudinal direction relative to each other along the folding edge resulting in the absence of gaps between the punched spots of the staggered two perforation lines along the folded edge, the sheets are folded between the perforation lines for building double sheets forming a front and a rear sided sheet, the punched spots results in alternating recesses along the folding line, which are used as adhesive receiving areas, the double sheets are arranged joining each other and are applied with an adhesive on surfaces associated to each other, produced by double perforations between the recesses of the one perforation line and recesses of the other perforation line, and the double sheets processed in this manner lying one above the other are pressed with the recesses of the subsequent double sheets into a book block.

2. The process as claimed in claim 1, wherein the folding edge is produced by perforating cuts in the longitudinal direction, which perforation cuts extend in a meander type, the folding edge is formed by two perforation lines extending in a small distance from and parallel to each other, the perforation of the folding edge is cut in the longitudinal direction by the knife teeth, and a respective transversal slot between the end of one perforation cut of the first perforation line and the beginning of an associated second perforation cut of the second perforation line is interrupted.

3. The process as claimed in claim 1, wherein perforation of the folding edges is performed by a perforating device which is made up of two symmetrical positioned halves and which is carried out by means of linear or circular punching tools.

4. The process as claimed in claim 1, wherein perforation lines are formed extending in a meander-type line.

5. The process as claimed in claim 1, wherein perforation lines of a are formed extending in a dovetail-type line.

6. The process as claimed in claim 3, wherein the punching tools are formed so that the halves of the sheets subsequent to the punching step are still connected with each other by transversal slots, and that the two punched halves of the sheets subsequent to the slitting or punching step are folded together.

7. The process as claimed in claim 6, wherein longitudinal slots of the perforations line are connected by transversal slots and wherein the transversal slots are discontinuous to form hinge points.

8. The process as claimed in claim 1, wherein the perforation lines are punched or cut into the stack of sheets, which are to be combined into a book block, the punched sheets are staggered by one tooth pitch in an alternating manner, and the sheets are put together.

9. The process as claimed in claim 8, wherein the sheets put together in a book block are cut or punched equally, and subsequent thereto each second sheet is staggered in view of the first sheet by one half of a pitch.

10. The process as claimed in claim 1, wherein the recesses are provided with a transition region and further in which along the widened folding edge at the transition region of the recesses of the one sheet to the transition region of the recesses of the adjacent sheet a virtual hinge line is formed.

11. The process as claimed in claim 1, in which the distance between the two perforation lines is altered dependent on the thickness of paper and is adapted thereto.

12. The process as claimed in claim 10, in which the virtual hinge line is formed by hinge means in the center of transversal slots, which connect the two meander-type lines extending in the longitudinal direction with each other.

13. A device for performing the process according to claim 1, comprising means for perforating and folding the sheets to be combined into a book block at the folding edge, and for applying adhesive material at the edges thereof, wherein two perforating knives or, alternatively, the two halves of a double perforating knife are variably connected back to back in a distance of one or several paper thicknesses with each other, the cutting edges are arranged in the direction of two parallel perforation lines, the two perforation knives or the two halves of a double perforation knife have perforation teeth which are parallel to each other by one perforation tooth, and staggered by the length of one perforating tooth in longitudinal direction relative to each other along the folding edge in absence of longitudinal gaps, and the perforation areas or the recesses produced when folding the sheets between the two perforation lines and corresponding with the individual perforation teeth form the adhesive applying areas.

14. The device as claimed in claim 13, wherein the perforation tool is a one-part knife in the form of a double slot perforation knife, the cutting edge of which has a meander-like path, the meander sections of the cutting edge extend in the longitudinal direction of the perforation line result in recesses, which at the perforation line open alternately to the one and to the other side, form the adhesive areas, and transversal slots of the perforation line, which restrict two adjacent recesses in transversal direction, are formed by continuous or alternately interrupted cutting edges.

15. The device as claimed in claim 13, wherein the cutting edges of the perforation knife or alternatively the two halves of a double perforation knife extend in a meander-type path, whereby the cutting edges penetrating the sheet material result in meander-type separation lines, the longitudinally extending cutting edges cut through the material and generate an interrupted cutting line each, and the transversely extending cutting edges do not or not entirely cut through the material and at least leave a transversal spot in the form of a connection, whereby the hinges resulting therefrom in their entirety form a virtual hinge line as a hinge axis.

16. The device as claimed in claim 13, wherein the longitudinal slots at both sides of the longitudinal axis are arranged in a continuous sequence, the longitudinal slots at both sides of the longitudinal axis are staggered in the longitudinal direction by the length of a knife tooth, and the recesses of the two parallel perforation lines in combination form a continuous, strip-like area across the entire length of the perforation lines with the width of transversal slots.

17. The device as claimed in claim 13, wherein the two cutting knives or alternatively the two halves of a double perforation knife connected back to back are adjustable in a transverse direction relative to each other in order to alter the width of the folding line.

18. The process according to claim 1, wherein two perforated sheets folded about the folding edge comprise a continuous bonding area in the longitudinal direction with the width of the alternating recesses.

* * * * *